United States Patent [19]

Jacobsen

[11] Patent Number: 4,498,524

[45] Date of Patent: Feb. 12, 1985

[54] HEAT EXCHANGER WITH BY-PASS

[76] Inventor: Orval E. Jacobsen, Box 3429, #2 Caravaca La., Hot Springs Village, Ark. 71909

[21] Appl. No.: 429,038

[22] Filed: Sep. 30, 1982

Related U.S. Application Data

[60] Division of Ser. No. 822,712, Aug. 8, 1977, Pat. No. 4,371,027, which is a continuation-in-part of Ser. No. 612,043, Sep. 10, 1975.

[51] Int. Cl.[3] ..... G05D 23/00; B60H 1/00; F28F 27/02

[52] U.S. Cl. ..... 165/36; 165/39; 165/40; 165/103; 165/DIG. 2; 165/134 DP

[58] Field of Search ..... 165/35, 36, 39, 40, 165/102, 103, 156, 134 DP, 163, DIG. 2; 122/20 B, 421; 237/55; 236/13, 93 R

[56] References Cited

U.S. PATENT DOCUMENTS

| | | | |
|---|---|---|---|
| 687,735 | 12/1901 | Elmendorf | 165/102 |
| 780,736 | 1/1905 | Stack | 122/20 B |
| 1,633,759 | 6/1927 | Breese, Jr. | 165/35 |
| 1,885,267 | 11/1932 | Kalfus | 122/20 B |
| 2,521,866 | 9/1950 | Ott | 165/134 DP |
| 2,823,026 | 2/1958 | D'Amico et al. | 165/40 |
| 3,062,510 | 11/1962 | Percival | 165/36 |
| 3,223,150 | 12/1965 | Tramontini | 165/35 |
| 3,392,777 | 7/1968 | Edgemond, Jr. et al. | 165/35 |
| 3,991,821 | 11/1976 | Cook et al. | 165/103 |
| 4,319,630 | 3/1982 | Hronek et al. | 165/35 |

FOREIGN PATENT DOCUMENTS

| | | | |
|---|---|---|---|
| 46476 | 3/1982 | European Pat. Off. | 165/39 |
| 2854584 | 6/1980 | Fed. Rep. of Germany | 165/35 |
| 162032 | 5/1933 | Switzerland | 122/20 B |
| 220456 | 9/1942 | Switzerland | 165/DIG. 2 |
| 1826 | of 1915 | United Kingdom | 165/103 |
| 530159 | 12/1940 | United Kingdom | 165/103 |

*Primary Examiner*—William R. Cline
*Assistant Examiner*—Edward P. Walker
*Attorney, Agent, or Firm*—Head, Johnson & Stevenson

[57] ABSTRACT

A method and means for extracting heat from an exhaust stack under highly corrosive and fluctuating conditions. An in-line exhaust gas heat exchanger having selective dual concentric exhaust paths and having a plurality of longitudinal structural stringers to insure against weakening of the exhaust stack. A plurality of heat exchanger coils are located in the outermost exhaust path and means is provided for fully draining the liquid contents thereof. Temperature control method means is provided for regulating the temperature of fluid within the coils due to exhaust stack temperature fluctuations for controlling critical dew point situations.

7 Claims, 4 Drawing Figures

HEAT EXCHANGER WITH BY-PASS

CROSS-REFERENCES

The present application is a division of application Ser. No. 822,712, filed Aug. 8, 1977, which is now U.S. Pat. No. 4,371,027, issued Feb. 1, 1983, which is in turn a contination-in-part of the previous filed patent application Ser. No. 612,043, filed Sept. 10, 1975 for heat exchanger with bypass.

BACKGROUND OF THE INVENTION

1. Field of the Invention

The present invention relates to heat exchangers and more particularly, but not by way of limitation, to an in-line exhaust gas exchanger for heating or preheating fluid by waste hot exhaust gases and including means for controlling the temperature of the fluid and for prevention of corrosion to the heat exchanger itself.

2. Description of the Prior Art

Heretofore, in-line exhaust heat exchangers of the type disclosed of the patent to Elmendorf, U.S. Pat. No. 687,735 dated Dec. 3, 1901 and entitled "Heating Device for Liquids" were used in exhaust gas pipes. It was long ago recognized that such heat exchangers often called economizers are desirable for use in exhaust gas smoke stacks and the like but were extremely limited in their use to non-sulphur or very low sulphur fuels and only on boilers with non-fluctuating loads.

Exhaust gases from oil and coal fired boilers contain sulphur. In an economizer these gases are cooled and a sulphur dew point temperature may be reached. At this dew point temperature, sulphur, together with water vapor condense and form actively corrosive sulphuric and sulphurous acids. This can cause an extremely corrosive situation wherever these liquids do occur.

As stated, this condition previously limited the use of economizers to non-sulphur or very low sulphur fuels. Since boilers with fluctuating loads often caused stack temperature fluctuations resulting in "dew point" situations, in-line exhaust gas heat exchangers were limited to non-fluctuating-load boilers or incinerators.

The use of various alloys in construction of the economizer most often did not stop corrosion and never prevented acid formation. Therefore, a method of controlling the exhaust gas temperature of the economizer is mandatory.

A further problem present in the Elmendorf type device is that even where the damper or butterfly valves for routing the exhaust gases are in the open position a large portion of the hot exhaust gas would still move around the inner exhaust pipe and past the heat exchanger elements, causing unwanted heating of the liquid within the helical chamber.

Further, since the inner pipe of Elmendorf is supported within the outer pipe by means of the helical heat exchanger elements, a great amount of unwanted heat transfer takes place when the damper is open.

Another disadvantage of the prior art devices is that since the outer sleeve or housing is the primary load carrying member, it renders the device very difficult to provide maintenance for the heat exchange elements without first removing the device from the stack and temporarily supporting the stack during such maintenance. Since the economizer is normally inserted in an existing smoke stack, the Elmendorf type device has proved to be incapable of carrying the structural load required without greatly beefing up the outer wall of the heat exchanger or providing some other means for carrying the load of the exhaust stack above the heat exchanger.

SUMMARY OF THE PRESENT INVENTION

The present invention provides a helical coil heat exchanger or economizer having an integral straight through bypass as a very practical method to control exhaust temperatures and is particularly designed and constructed for overcoming the above disadvantages.

The present economizer utilizes a pair of concentric cylindrical wall members which provides two exhaust paths, one through the center wall member and the second through the space between the wall members. A plurality of helical coil members are provided in the outer annular passageway for the passing of liquids therethrough and the center passageway is provided with a damper or butterfly valve near the inlet port thereof. A heat sensor is installed on the downstream side of the exchanger to monitor stack temperature after the exhaust gas has passed through the heat exchanger. This signal is used to control the bypass damper to guard against temperature falling below the dew point level of the exhaust gas. The damper can alternatively be controlled by a heat sensor located on the downstream side of the liquid flowing through the helical coils in order to maintain desired liquid temperature during conditions when dew point is not necessarily a problem.

The signals provided by the stack temperature probes are used to control the bypass damper which will open as the exhaust temperatures approach the dew point thereby allowing the gases to pass through the central passageway directly into the stack. The damper would close as the exhaust temperatures rise above safe limits in regard to dew point temperatures which would then route the exhaust gas through the outer passageway past the helical coils containing the liquid or fluid that is being heated. On the other hand, when it is desired to monitor or control the temperature of the liquid in the bypass system the same bypass damper control can be operated by heat sensor signals from the downstream side of the liquid in the helical coils.

The load carrying structure of the present invention primarily consists of a pair of oppositely disposed truncated conical segments made of heavy duty steel or the like and capable of supporting heavy loads. These conical end segments are held in spaced relationship by means of a plurality of radially spaced longitudinal load carrying stringers attached therebetween. The smaller or outer ends of the truncated conical segments are then attached by means of suitable flanges or the like to the ends of the smoke stack and the entire load of the smoke stack is transmitted through the heat exchanger by means of the longitudinal stringers. The inner exhaust pipe simply consists of a pipe segment within and between the end segments and which is attached to the stringers through a layer of insulation.

The plurality of helical heating coils is then suspended outside of the layer of insulation directly to the stringers for pumping various liquids or fluids therethrough. The heat exchange coils are then surrounded by an outer casing or shell which is made up of a pair of hinged half cylinders which are readily openable for maintenance of the heat exchanger elements while the heat exchanger is in position in the exhaust stack. A butterfly valve is operably connected within the inner pipe segment at the inlet end for cutting off flow of exhaust gases therethrough and thereby directing the flow through the annular space created between the inner and the outer pipe segments. This butterfly valve is controlled by a servo mechanism which is operably connected to a temperature probe at the outlet of the coils so that the desired amount of heat exchange can take place.

A cylindrical sleeve member is provided at the bottom of the conical sections for a two-fold purpose, the first being to create a trough or moisture trap at the base of the heat exchanger which may be drained to prevent corrosion and further to more effectively direct exhaust gases through the center chamber when the butterfly valve is open.

DESCRIPTION OF THE DRAWINGS

Other and further advantageous features of the present invention will hereinafter more fully appear in connection with the detailed description of the drawings in which.

DESCRIPTION OF THE PREFERRED EMBODIMENT

Figure 1:
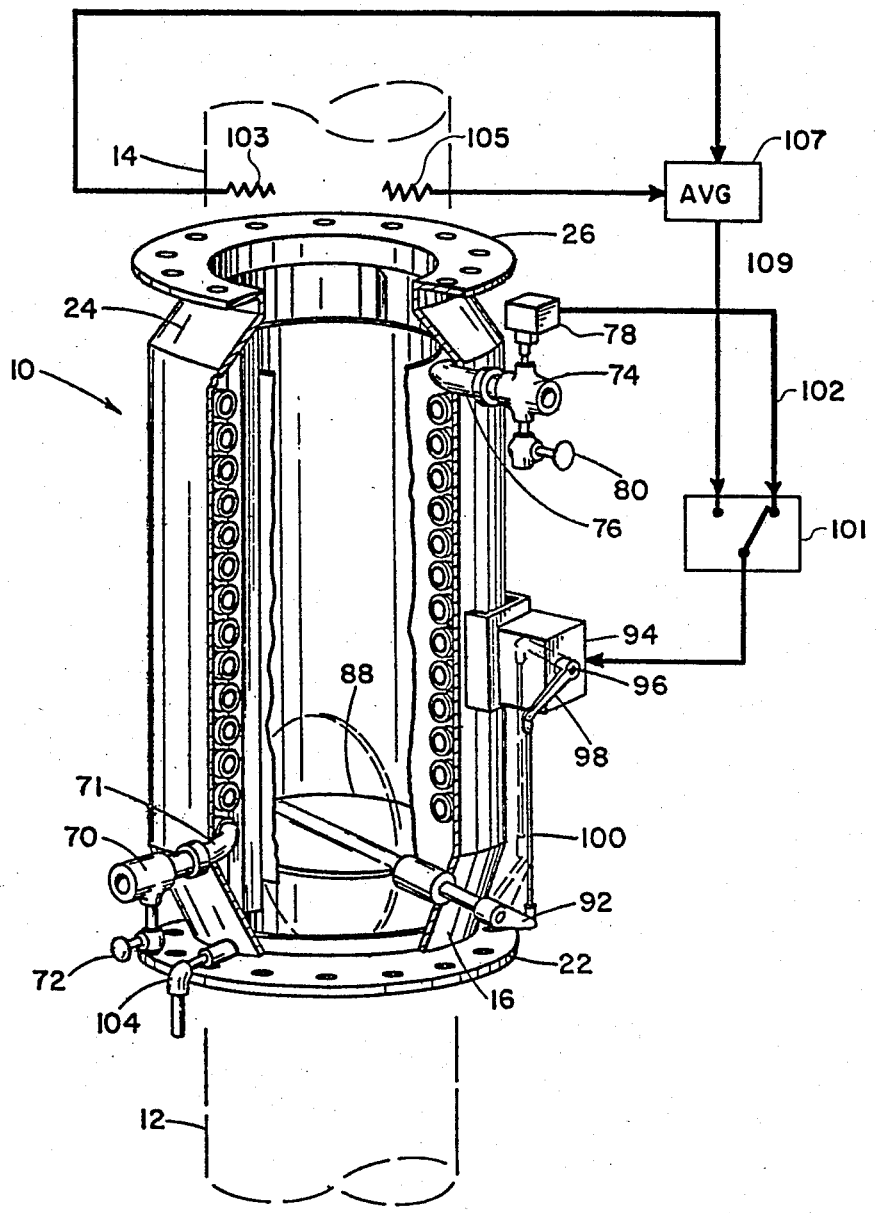
FIG. 1 is a partial cut away perspective view of an in-line exhaust gas heat exchanger embodying the present invention.

Referring to the drawings in detail, reference character 10 generally indicates an in-line exhaust gas heat exchanger connected between two vertical segments 12 and 14 representing an exhaust stack from an incinerator or the like (not shown). The heat exchanger 10 generally comprises a first lower truncated conical end segment 16 with its smaller lower end being secured to a cylindrical sleeve segment 18 in any well known manner such as by welding. The upper end of the cylindrical sleeve member 18 is disposed above the bottom portion of the conical segment 16. The upper larger end of the conical end segment 16 is provided with a vertically disposed cylindrical segment 20 for attachment purposes that will be hereinafter set forth. An outwardly extending flange member 22 is provided at the lower end of the segment 16 and which may be welded to the sleeve member 18. The segment 16, sleeve 18, and flange 22 may be constructed as an integral welded unit as shown. The flange member 22 is for attachment to a suitable corresponding flange member (not shown) on the upper end of the stack segment 12.

Figure 4:
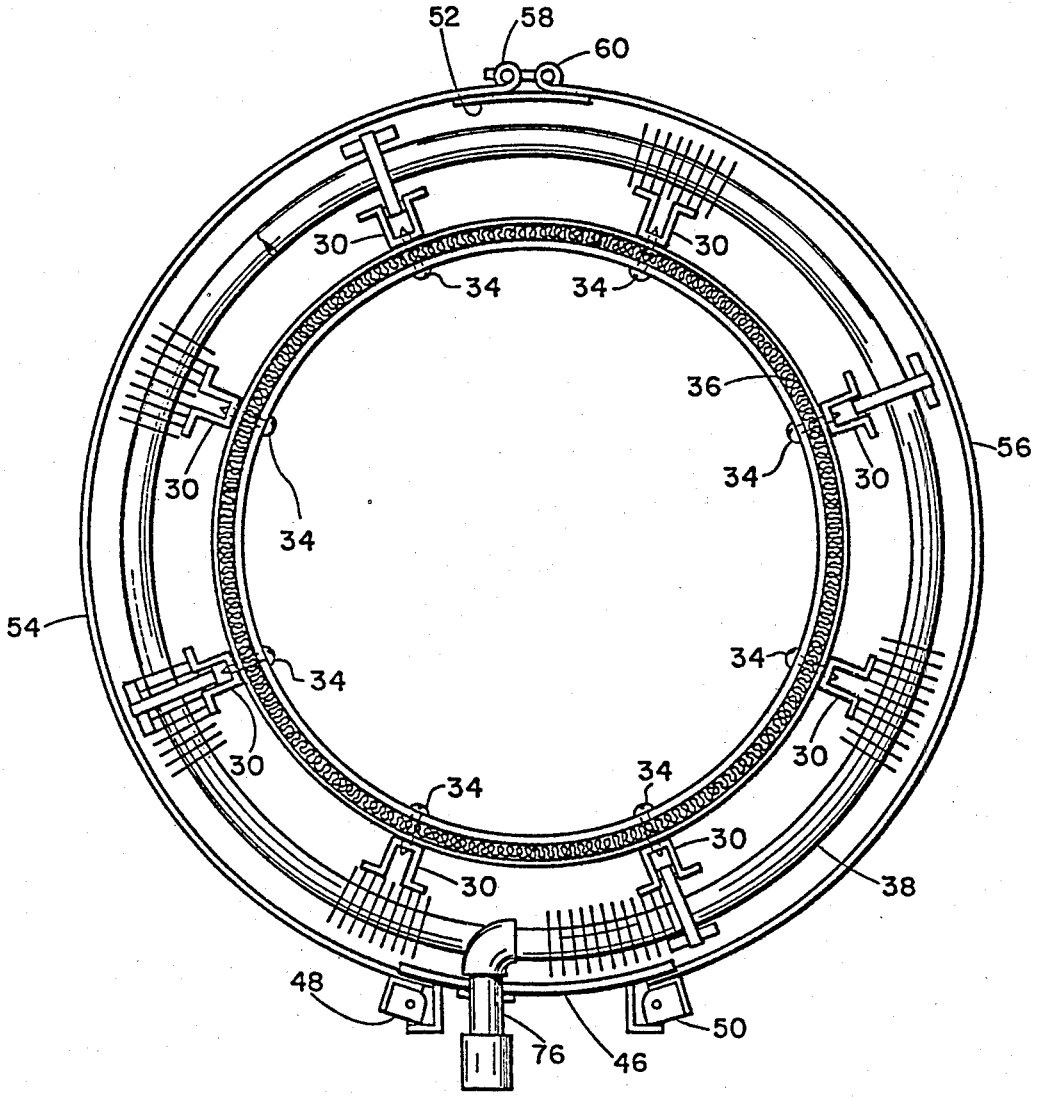
FIG. 4 is a top sectional view of the heat exchanger as shown in FIG. 3.

The heat exchanger also comprises a substantially identical oppositely disposed truncated conical end segment 24 which is spaced above the segment 16 with the upper smaller end thereof being provided with an outwardly extending flange member 26 which may also be constructed by integral welded parts for attachment to a corresponding flange member (not shown) on the lower end of the stack segment 14. The lower larger ends of the conical segment 24 is provided with a downwardly extending cylindrical segment 28 for a purpose that will be hereinafter set forth. The segments 16 and 24 are constructed of rather heavy material for load carrying purposes and are structurally connected together by means of a plurality of longitudinal or vertically disposed radially spaced stringers 30 which are attached thereto by any well known manner such as by welding. The stringers 30 may take on a hat section configuration as shown in FIG. 4.

The heat exchanger also comprises an inner sleeve or pipe segment 32, the upper and lower ends terminating adjacent the inside ends of the conical sections 16 and 24. The inner pipe segment 32 is attached to the stringers 30 by means of a plurality of pin members 34. A cylindrical shaped layer of thermal insulation material 36 is provided between the inner pipe segment 32 and the stringers 30.

A helical shaped heat exchange coil 38 is disposed around the outer periphery of the stringers 30 surrounding the inner pipe segment 32. The coils 38 are attached to the stringer members by means of a plurality of hanger wires 40 and associated pin members 42. The stringer members serve to separate the coil members from contact with the inner pipe segment 32 or the insulation 36 therearound. The coils 38 are hollow and are capable of fluid flow therethrough either in the gaseous state or in a liquid state.

The heat exchanger 10 is enclosed by an outer shell member or pipe segment 44 which is attached to the sleeve members 20 and 28. The outer segment 44 comprises a partial cylindrical vertically disposed panel 46 which is attached directly to the sleeve members 20 and 28 in any well known manner such as by welding or the like. The outer edges of the panel 46 are provided with tightenable hinge assemblies 48 and 50. A second vertically disposed strip 52 is attached to the cylindrical segments 20 and 38 diametrically opposite the strip 46. The remainder of the cylindrical shell 44 is made up of a pair of substantially half cylindrical segments 54 and 56, one edge of the shell portion 54 being hingedly attached to the hinge member 48 and one edge of the shell member 56 being hingedly attached to the hinge member 50. The opposite vertical edges of the shell members 54 and 56 are provided with latch members 58 and 60 which form an overlapping latch mechanism with the vertical strip 52. The upper and lower edges of the outer shell member 44 are provided with annular grooves 62 and 64 for receiving sealing bands 66 and 68 therein, respectively.

The lower end of the helical coil 38 is operably connected through the wall of the outer shell member to a fluid inlet port 70 by a tube segment 71. The fluid inlet port is then connectable with a fluid source for which heating is desirable. The inlet port 70 is provided with a drain valve 72 for purposes that will be hereinafter set forth.

The upper end of the helical coil 38 is connected to a fluid outlet port 74 by means of a tube section 76 which extends through the vertical panel 46 of the outer shell. The outlet port 74 is provided with a temperature probe means 78 in communication with the interior thereof for measuring the temperature of the fluid after it has travelled through the heat exchanger. The outlet port 74 is also provided with a drain valve 80. A horizontal shaft 82 is pivotally secured to opposite sides of the cylindrical sleeve member 20 by means of a pair of bearing members 84 and 86. Secured to the shaft 82 is a circular disc member 88 disposed within the inner pipe segment 32 constituting a butterfly valve for closing off the bottom portion of said pipe segment 32. The circular disc is strengthened by means of transversely disposed web members 90. These web members 90 are arranged so that when the butterfly valve is open as shown by the dashed lines in FIG. 2 the web members 90 will be in alignment with the flow of exhaust gas therethrough.

The shaft 82 extends outside the heat exchanger outer shell, the outer end of which is attached to a crank-arm 92. A servo mechanism 94 is attached to the vertical panel member 46 outside the heat exchanger body and is also provided with an output rotating shaft 96. The shaft 96 is provided with a crank arm 98. A stiff rod 100 is pivotally attached to the outer ends of the crank arms 92 and 98 for slaving the movement of one with the other. The servo mechanism 94 is operably connected to the temperature probe 78 by means of an electrical line 102 passing through a switching box 101 shown in schematic form in FIG. 1. The servo means 94 may be preset to respond to a desired temperature and is provided with well known means for comparing the temperature reading from the probe 78 with that of the desired temperature and thereby pivoting or rotating the valve disc 88 to a position to achieve the desired fluid temperature exiting from the coils 38.

A second pair of temperature probes 103 and 105 are installed at or near the downstream side of the heat exchanger in direct communication with the exhausted gases thereform. The temperature probes 103 and 105 may be actually installed in the stack directly above the heat exchanger or can be made as an integral part of the upper end of the heat exchanger. The output from the temperature probe 103 and 105 are connected into an averaging circuit 107 the output of which is directly proportional to the average of the temperatures detected by the probes 103 and 105. The output of the averaging box 107 is provided by electrical line 109 directly to the switching device 101. Again the servo means 94 may be preset to respond to the desired lower limit of the exhaust temperature so that if the exhaust gas temperature becomes critically low, near the dew point level of the exhaust gases, the servo means 94 will pivot the valve disc 88 to a position to allow exhaust gases to pass directly through the center pipe segment 32 bypassing the helical coils 38 in order to keep the temperature of the exhaust gases above dew point for purposes that have been hereinbefore set forth.

When it becomes desirable to clean the coils by an acid solution or the like, such acid solution may be introduced by means of the valve 80 at the top of the coils or through the coil outlet allowing the acid or cleaning solution to travel through the coils and be removed by the valve 72 at the bottom end of the coil.

Figure 2:
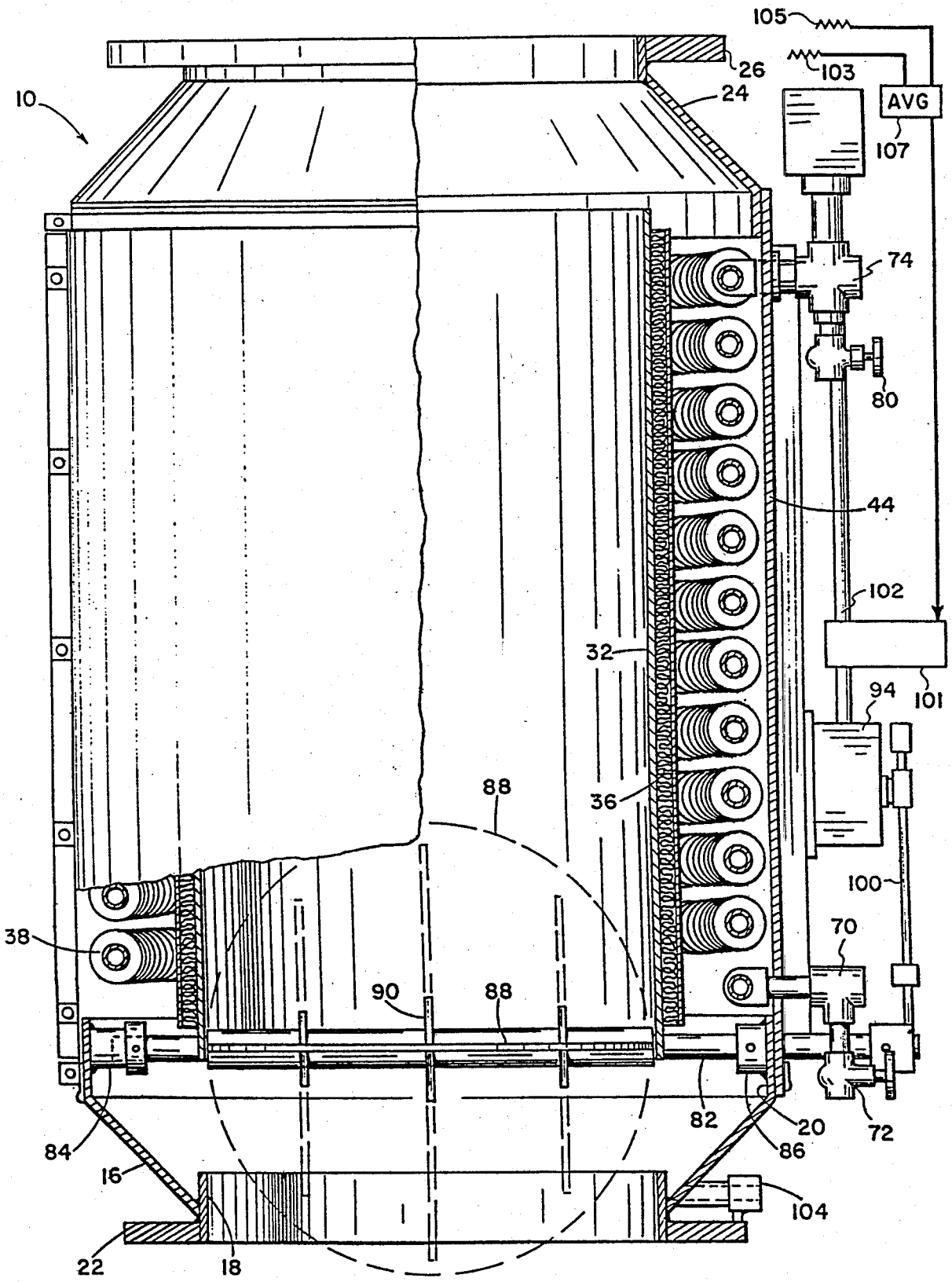
FIG. 2 is a partial sectional elevational view of the heat exchanger of FIG. 1.
Figure 3:
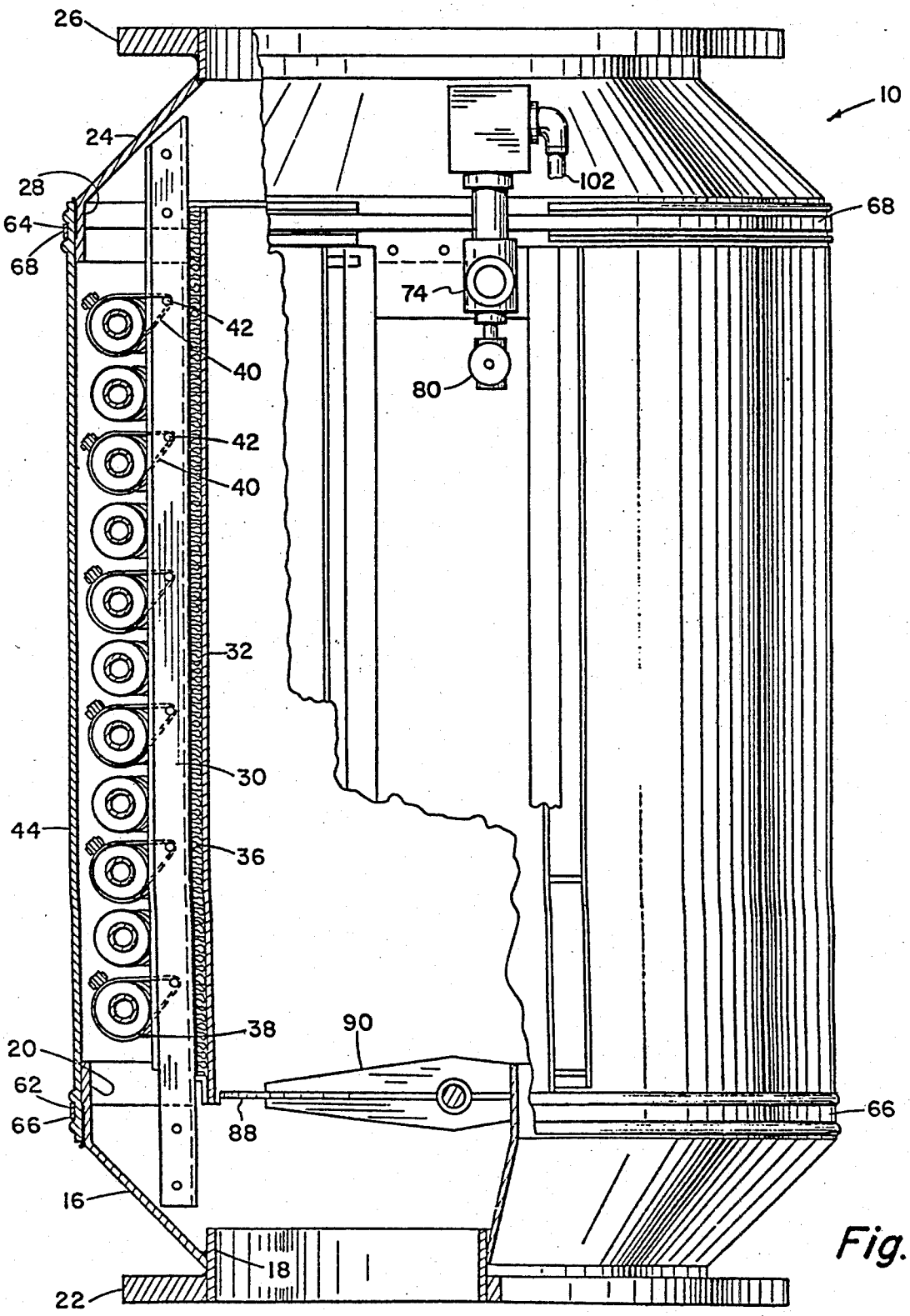
FIG. 3 is a partial sectional elevational view of the heat exchanger of FIG. 2 viewed at a right angle thereto.

The trough formed between the sleeve member 18 and the lower conical segment 16 serves the purpose of trapping any water or chemical caused by condensation around the coils or elsewhere in the heat exchanger. This liquid that might be trapped within the aforementioned trough may be emptied by means of a valve 104 which is provided through the truncated conical segment 16 as shown in FIGS. 1 and 2.

In operation fluid such as water may be piped in and through the coils of the heat exchanger while hot gases flow through the stack. If the source of the exhaust gas is highly fluctuating, and/or is particularly high in sulphur content, it is desirable to very closely monitor the dew point temperatures of the exhaust gases to prevent the formation of sulphuric and sulphurous acids upon condensation. Therefore, during such operations it would be advisable to operate the switching device in order to connect the output of the exhaust gas temperature probe 103 and 105 directly to the servo means 94 so that when the exhaust gas temperature falls below a predetermined dew point depression level, the circular disc member 88 may be rotated to a vertical position allowing the exhaust gases to travel directly through the inner pipe segment 32 thereby taking heat off of the helical coil 38 in an attempt to maintain the temperature of the exhaust gases high enough to prevent condensation. Naturally, when the temperature fluctuates to a higher level, the exhaust valve 88 may again be rotated toward the closed position thereby allowing the exhaust gases to pass through and around the helical coils 38 in order to heat the fluid therein.

During operations in which the exhaust gases are either non-fluctuating or are cycling well above the dew point temperature of the exhaust gas, switching device 101 may be operated to connect temperature probe 78 directly to the servo means 94 so that the outlet temperature of fluid passing through the helical coil 38 may be maintained at a desired temperature.

It is noted that the diameter of the inner pipe segment 32 is substantially equal to the diameter of the stack 12 and 14 so as not to substantially impede the flow of exhaust gases therethrough. Likewise, the diameter of the outer pipe segment 44 should be at least the square root of two times that of the inner pipe segment so that when the valve 88 is fully closed sufficient space is provided between the outer pipe segment and the inner pipe segment to allow the exhaust gases again to flow substantially unimpeded.

From the foregoing, it is apparent that the present invention provides an in-line exhaust gas heat exchanger which is particularly designed and constructed for use in a hot gas exhaust stack operation and which is structurally adequate without exterior support in existing stack installations. It is further apparent that when heat exchange operation is undesirable, the valve member may be turned fully open and the insulation material between the inner pipe segment and the heat exchanger coils greatly reduces any undesirable heat transfer therethrough.

Whereas, the present invention has been described in particular relation to the drawings attached hereto it is apparent that other and further modifications can be made apart from those shown or suggested herein which will be within the scope of the invention.

What is claimed is:

1. An in-line exhaust gas heat exchanger for use with a vertical exhaust stack having a lower portion below the heat exchanger and an upper portion above the heat exchanger, comprising:

(a) a pair of concentrically spaced vertically disposed cylindrical segments forming a vertical central passageway having a diameter substantially equal to the inside diameter of the exhaust stack upper and lower portions, and a vertical annular passageway between the cylindrical segments having a cross-sectional area greater than that of the central passageway, both said passageways being in open communication with upper and lower portions of the exhaust stack at the respective ends of the heat exchanger, a pair of oppositely disposed coaxial upper and lower end coupling members attachable to the exhaust stack upper and lower portions respectively and a plurality of vertical load carrying stringers connected between the coupling members to support the weight of the upper exhaust stack;

(b) fluid carrying heat exchange coils disposed in the annular passageway and having fluid inlet and outlet ports;

(c) a temperature probe means in communication with the exhaust gas passing through at least one of said passageways;

(d) a butterfly valve disposed in the lower end of the central passageway;

(e) means operably connected to the butterfly valve and responsive to the output of the temperature probe means for controlling the position of the butterfly valve within preselected limits; and (f) said lower end coupling member being provided with a trough in communication with the annular passageway for trapping condensation moisture, and a drain attached to the lower portion of said trough and in communication with said trough for draining same; wherein the position of the butterfly valve may be controlled by preselected temperature limits detected by the temperature probe means.

2. A heat exchanger as set forth in claim 1 wherein the heat exchanger coils are suspended between the inner and outer pipe segments by a plurality of hanger straps connected to the stringers and including a layer of thermal insulation surrounding the inner cylindrical segment.

3. A heat exchanger as set forth in claim 1 wherein the lower end of the helical coil is provided with a drain valve.

4. A heat exchanger as set forth in claim 1 wherein the outer cylindrical segment comprises a pair of elongated half cylindrical segments, having two pairs of vertical edges, one edge of each segment being vertically hinged together, and the other edge of each segment being connectable together so that said segments surround the heat exchanger coil.

5. A heat exchanger as set forth in claim 1 wherein said temperature probe means includes a first temperature probe in communication with said fluid outlet port and a second temperature probe in communication with the upper ends of said exhaust gas passageways.

6. A heat exchanger as set forth in claim 5 wherein the second temperature probe comprises a plurality of temperature transducers disposed in communication with the upper end of the exhaust gas heat exchanger, an averaging circuit operably connected to the output of said temperature transducers capable of producing an output proportional to the average of the detected temperatures, the output of said temperature averaging circuits being operably connected to the means responsive to the output of the temperature probes.

7. A heat exchanger as set forth in claim 5 and including switching means interposed between the temperature probes and the means responsive to the temperature probes and being capable of selection of either the first temperature probe or the second temperature probe.

* * * * *